US011535819B2

(12) United States Patent
Bernard et al.

(10) Patent No.: US 11,535,819 B2
(45) Date of Patent: Dec. 27, 2022

(54) UNIT DOSE DETERGENT PACK INCLUDING A LIQUID DETERGENT COMPOSITION WITH IMPROVED COLOR STABILITY

(71) Applicant: Henkel AG & Co. KGaA, Duesseldorf (DE)

(72) Inventors: Andrew Neal Bernard, East Lyme, CT (US); Wei Sun, Trumbull, CT (US); Casey Elphege Camire, Wallingford, CT (US); Daniel Thomas Piorkowski, Fairfield, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 16/837,112

(22) Filed: Apr. 1, 2020

(65) Prior Publication Data

US 2021/0309948 A1 Oct. 7, 2021

(51) Int. Cl.

| | |
|---|---|
| ***C11D 17/04*** | (2006.01) |
| ***C11D 3/00*** | (2006.01) |
| ***C11D 3/04*** | (2006.01) |
| ***C11D 3/30*** | (2006.01) |
| ***C11D 3/37*** | (2006.01) |
| ***C11D 1/29*** | (2006.01) |

(Continued)

(52) U.S. Cl.

CPC ..... *C11D 17/043* (2013.01); *C11D 1/04* (2013.01); *C11D 1/29* (2013.01); *C11D 1/66* (2013.01); *C11D 3/0005* (2013.01); *C11D 3/042* (2013.01); *C11D 3/046* (2013.01); *C11D 3/30* (2013.01); *C11D 3/3463* (2013.01); *C11D 3/37* (2013.01); *C11D 3/3719* (2013.01); *C11D 3/3773* (2013.01)

(58) Field of Classification Search

CPC .... C11D 1/04; C11D 1/29; C11D 1/66; C11D 3/37; C11D 3/3719; C11D 3/3463; C11D 17/043

USPC ..... 510/296, 351, 356, 439, 475, 488, 492, 510/504

See application file for complete search history.

(56) References Cited

U.S. PATENT DOCUMENTS

| | | | |
|---|---|---|---|
| 5,616,781 | A | 4/1997 | Sajic et al. |
| 6,024,943 | A | 2/2000 | Ness et al. |

(Continued)

FOREIGN PATENT DOCUMENTS

| | | | |
|---|---|---|---|
| DE | 102017209211 | A1 | 12/2018 |
| WO | 1995032997 | A1 | 12/1995 |

(Continued)

OTHER PUBLICATIONS

European Search Report Application No. EP 21154500 Completed: Jun. 25, 2021 dated Jul. 5, 2021.

*Primary Examiner* — Gregory R Delcotto
(74) *Attorney, Agent, or Firm* — Bojuan Deng

(57) ABSTRACT

A unit dose detergent pack is disclosed. The unit dose detergent pack includes a pouch formed from a water-soluble film and a liquid detergent composition releasably disposed within the pouch. The liquid detergent composition includes an alkanolamine, an acid, a copolymer formed from first and second monomers with the first monomer being diallyldimethylammonium chloride (DADMAC), and an alkali metal sulfite or bisulfite. The copolymer and the alkali metal sulfite or bisulfite interact with at least one of the alkanolamine and the acid to reduce discoloration of the liquid detergent composition.

17 Claims, 7 Drawing Sheets

(51) Int. Cl.

| | |
|---|---|
| ***C11D 1/04*** | (2006.01) |
| ***C11D 1/66*** | (2006.01) |
| ***C11D 3/34*** | (2006.01) |

(56) References Cited

U.S. PATENT DOCUMENTS

| | | | | |
|---|---|---|---|---|
| 6,056,949 | A | 5/2000 | Menzi et al. | |
| 6,194,375 | B1 | 2/2001 | Ness et al. | |
| 6,458,754 | B1 | 10/2002 | Velazquez et al. | |
| 8,426,353 | B2 | 4/2013 | Ouali et al. | |
| 8,716,213 | B2 | 5/2014 | Caggioni et al. | |
| 2011/0162154 | A1* | 7/2011 | Corona, III | D06M 15/61 8/441 |
| 2011/0224127 | A1 | 9/2011 | Blyth et al. | |
| 2011/0319311 | A1* | 12/2011 | Labeque | C11D 10/04 510/296 |
| 2014/0323383 | A1* | 10/2014 | Trujillo | C11D 17/043 510/439 |
| 2015/0376550 | A1 | 12/2015 | Ohatani | |
| 2017/0165169 | A1 | 6/2017 | Schelges | |
| 2017/0175059 | A1* | 6/2017 | Depoot | C11D 3/001 |
| 2017/0335237 | A1 | 11/2017 | Fossum et al. | |

FOREIGN PATENT DOCUMENTS

| | | | |
|---|---|---|---|
| WO | 20050087907 | A1 | 9/2005 |
| WO | 2010069957 | A1 | 6/2010 |
| WO | 20150143997 | A1 | 10/2015 |
| WO | 2019014086 | A1 | 1/2019 |
| WO | 2019084375 | A1 | 5/2019 |
| WO | 2019117902 | A1 | 6/2019 |

* cited by examiner

Sulfite Effects

Noverite Effects

----- Sulfite Effects

..... Noverite Effects

UNIT DOSE DETERGENT PACK INCLUDING A LIQUID DETERGENT COMPOSITION WITH IMPROVED COLOR STABILITY

FIELD OF THE INVENTION

The present disclosure relates generally to unit dose detergent packs and, more particularly, to a unit dose detergent pack including a liquid detergent composition with improved color stability.

BACKGROUND OF THE INVENTION

Product discoloration such as yellowing is a known technical challenge to liquid detergent compositions over the product shelf life. Particularly in compositions free of a colorant, the discoloration becomes more obvious over time often adversely impacting consumer perception of the detergent composition. Sulfite or bisulfite salts have been used to slow down the progression of discoloration of the detergent composition. However, for unit dose detergent packs, the sulfite or bisulfite is at least partially responsible for efflorescence on the surface of the water-soluble film of the unit dose pack over time. Therefore, there remains a need for improvement.

BRIEF SUMMARY OF THE INVENTION

The present disclosure provides a unit dose detergent pack comprising a pouch formed from a water-soluble film and a liquid detergent composition releasably disposed within the pouch. The liquid detergent composition comprises: an alkanolamine; an acid; a copolymer formed from first and second monomers with the first monomer being diallyldimethylammonium chloride (DADMAC); and an alkali metal sulfite or bisulfite, wherein the copolymer and the alkali metal sulfite or bisulfite interact with at least one of the alkanolamine and the acid to reduce discoloration of the liquid detergent composition.

A liquid detergent composition is also provided. The liquid detergent composition comprises: an alkanolamine; an acid; a copolymer formed from first and second monomers with the first monomer being diallyldimethylammonium chloride (DADMAC); and an alkali metal sulfite or bisulfite, wherein the copolymer and the alkali metal sulfite or bisulfite interact with at least one of the alkanolamine and the acid to reduce discoloration of the liquid detergent composition.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The advantages of the present disclosure will be readily appreciated as the same becomes better understood by reference to the following detailed description when considered in connection with the accompanying drawings.

DETAILED DESCRIPTION OF THE INVENTION

Figure 1A:
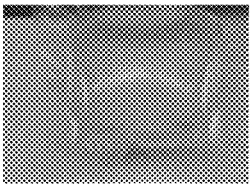
FIGS. 1A-1G are photographs of unit dose detergent packs including a liquid detergent composition without a copolymer including a diallyldimethylammonium chloride (DADMAC) after aging for one-week at varying temperatures.

The following detailed description is merely exemplary in nature and is not intended to limit the unit dose detergent pack, the liquid detergent composition for the unit dose pack of the present disclosure. Furthermore, there is no intention to be bound by any theory presented in the preceding background or the following detailed description.

Embodiments of the unit dose detergent pack and the liquid detergent composition for the unit dose detergent pack are described in detail below. The unit dose detergent pack includes a pouch formed from a water-soluble film and a liquid detergent composition releasably disposed within the pouch. Details of the liquid detergent composition are described first, and details of the pouch and the water-soluble film are described afterwards.

As used herein, the term "detergent" refers to a substance, preparation, agent, and/or the like containing a mixture of ingredients having cleansing properties. One example is a laundry detergent, which is a detergent formulated for washing or cleaning laundry. Another example is dishwashing detergent, which is a detergent formulated for washing or cleaning dishware, drinking glasses, eating or cooking utensils, etc. The detergent may be specifically formulated for use in washing and cleaning processes performed with a washing machine or for use in washing or cleaning processes performed by hand.

Alkanolamine

The liquid detergent composition of the present disclosure includes an alkanolamine. Although useful as a neutralizing agent of the composition, the alkanolamine tends to adversely affect the color stability of the liquid detergent composition over time. For example, liquid detergent compositions containing alkanolamine tend to discolor (e.g., yellow) over time due, at least in part, to a reaction between a carbonyl compound (such as an aldehyde or ketone present in the composition) and the alkanolamine. The "yellowing" of the liquid detergent composition is particularly noticeable in colorless compositions (i.e., those that are free of a colorant). However, the "yellowing" may also be noticeable in compositions including a colorant, such as a dye.

In an embodiment, the alkanolamine is used as a neutralizing agent and is chosen from monoethanolamine, diethanolamine, triethanolamine, isopropylamine, and combinations thereof. In another embodiment, the alkanolamine is monoethanolamine. The alkanolamine is present in the liquid detergent composition in an amount of from about 0.1 to about 10% by weight based on a total weight of the liquid detergent composition. In another embodiment, the alkanolamine is present in an amount of from about 0.5 to about 5% by weight based on a total weight of the liquid detergent composition. In another embodiment, the alkanolamine is present in an amount of from about 1 to about 4% by weight based on a total weight of the liquid detergent composition. In yet another embodiment, the alkanolamine is present in an amount of about 2.5 to about 3.5% by weight based on a total weight of the liquid detergent composition.

Alkali Metal Sulfite or Bisulfite

The liquid detergent composition further includes an alkali metal sulfite or bisulfite. In an embodiment, the alkali metal sulfite is chosen from sodium sulfite, potassium sulfite, and combinations thereof. The alkali metal bisulfite is chosen from sodium bisulfite, potassium bisulfite, and combinations thereof. The sulfite or bisulfite is used to improve color stability of the liquid detergent composition, such as by blocking the carbonyl site of the aldehyde or ketone thereby mitigating the reaction with the alkanolamine mentioned above. In an embodiment, the liquid detergent composition includes from about 0.01 to about 5% by weight of the alkali metal sulfite or bisulfite based on a total weight of the liquid detergent composition. In another embodiment, the liquid detergent composition includes from about 0.01 to about 3% by weight of the alkali metal sulfite or bisulfite based on a total weight of the liquid detergent composition. In yet another embodiment, the liquid detergent composition includes from about 0.5 to about 1.5% by weight of the alkali metal sulfite or bisulfite based on a total weight of the liquid detergent composition.

Copolymer

The liquid detergent composition further includes a copolymer formed from first and second monomers with the first monomer being diallyldimethylammonium chloride (DADMAC). As demonstrated by the Examples below, it was surprisingly and unexpectedly discovered that the presence of the copolymer provides a noticeable improvement in the color stability of the liquid detergent composition over time. It was also surprisingly and unexpectedly discovered that the copolymer in combination with the alkali metal sulfite or bisulfite interact with at least one of the alkanolamine and the acid to reduce discoloration of the liquid detergent composition. As demonstrated by the Examples below, the liquid detergent composition exhibits at least 40 units of brightness at a wavelength of about 457 nm (i.e., 457 nm Brightness) after aging for about two weeks at about 113° F. (45° C.) measured using an Ultrascan VIS Spectrophotometer, a visible-range color measurement spectrophotometer available from Hunter Associates Laboratory, Inc. (Reston, Va.). This is indicative of improved color stability compared to a liquid detergent composition that is free of the copolymer and the alkali metal sulfite or bisulfite.

As previously mentioned, the first monomer of the copolymer is diallyldimethylammonium chloride (DADMAC). The second monomer of the copolymer is acrylamide. The copolymer formed from the copolymerization of the DADMAC and acrylamide polymers is polyquaternium-7 (PQ7). In an embodiment, the copolymer is present in an amount of from about 0.05 to about 5% by weight based on a total weight of the liquid detergent composition. In another embodiment, the copolymer is present in an amount of from about 0.1 to about 4% by weight based on a total weight of the liquid detergent composition. In still another embodiment, the copolymer is present in an amount of from about 0.1 to about 2% by weight based on a total weight of the liquid detergent composition.

Surfactants

The liquid detergent composition further includes at least one surfactant. The surfactant(s) is used in the composition to facilitate foaming and stain removal, as well as to minimize redeposition of soils onto a fabric. In an embodiment, the liquid detergent composition includes an anionic surfactant, such as a linear alkylbenzene sulfonate (LAS). The linear alkylbenzene sulfonate is a water-soluble salt of a linear alkyl benzene sulfonate having from 8 to 22 carbon atoms of the linear alkyl group. The salt may be an alkali metal salt or an ammonium, alkylammonium, alkanolammonium salt. In an example, the linear alkylbenzene sulfonate includes an alkali metal salt of $C_{10}$-$C_{16}$ alkyl benzene sulfonic acids, such as $C_{11}$-$C_{14}$ alkyl benzene sulfonic acids. Suitable linear alkylbenzene sulfonates include sodium and potassium linear, alkylbenzene sulfonates with the average number of carbon atoms in the alkyl group being from 11 to 14. In one example, sodium $C_{11}$-$C_{14}$ linear alkylbenzene sulfonate is a suitable anionic surfactant for the structured liquid detergent composition. The linear alkylbenzene sulfonate is present in an amount of from about 1 to about 40% by weight based on a total weight of the composition. In another embodiment, the linear alkylbenzene sulfonate is present in an amount of from about 1 to about 30% by weight based on a total weight of the composition. In yet another embodiment, the linear alkylbenzene sulfonate is present in an amount of from about 5 to about 15% by weight based on a total weight of the composition.

It should be appreciated that the liquid detergent composition could include one or more other anionic surfactants in addition to the linear alkylbenzene sulfonate. For example, the plurality of surfactants could include alkyl ether sulfates (AES), such as sodium alkyl ether sulfate 25-3, and sodium alkyl sulfates, such as sodium lauryl sulfates (SLS). In an embodiment, the liquid detergent composition includes AES present in an amount of from about 10 to about 40% by weight based on a total weight of the liquid detergent composition. In another embodiment, AES is present in an amount of from about 20 to about 30% by weight based on a total weight of the liquid detergent composition. Although useful as a suitable surfactant for the liquid detergent composition, when present, AES is at least partially responsible for the efflorescence of the water-soluble film of the unit dose pack. Typically, the AES in combination with the alkali metal sulfite or bisulfite is responsible for the efflorescence of the water-soluble film. As demonstrated by the Examples below, it was surprisingly and unexpectedly discovered that the copolymer and the alkali metal sulfite or bisulfite also interact to reduce the efflorescence of the water-soluble film at least partially caused by the AES.

In an embodiment, the liquid detergent composition further includes a nonionic surfactant. The nonionic surfactant may be chosen from a wide range of nonionic surfactants. In an embodiment, the nonionic surfactant is chosen from, but not limited to, alkoxylated alcohols, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, or a combination thereof.

In another embodiment, the non-ionic surfactant is an alcohol ethoxylate (AE), such as alcohol ethoxylate 25-7 (referring to an alcohol ethoxylate having 12 to 15 carbon atoms and 7 moles of ethoxylation).

The alcohol ethoxylate may be primary and secondary alcohol ethoxylates, such as $C_8$-$C_{20}$ aliphatic alcohols ethoxylated with an average of from 1 to 20 moles of ethylene oxide per mole of alcohol. In another embodiment, the alcohol ethoxylate is a $C_{10}$-$C_{15}$ primary and secondary aliphatic alcohol ethoxylated with an average of from 1 to 10 moles, or from 3 to 8 moles of ethylene oxide per mole of alcohol.

Examples of alcohol ethoxylates include, but are not limited to, the condensation products of aliphatic $C_8$-$C_{20}$, preferably $C_8$-$C_{16}$, primary or secondary, linear or branched chain alcohols with ethylene oxide. In some embodiments, the alcohol ethoxylates contain 1 to 20, or 3 to 8 ethylene oxide groups, and may be end-capped by a hydroxylated alkyl group.

In one embodiment, the alcohol ethoxylate has the Formula (1):

$$R_2—(—O—C_2H_4—)_m—OH \quad (1);$$

wherein $R_2$ is a hydrocarbyl group having 8 to 16 carbon atoms and M is a number from 1 to 20. In another embodiment, $R_2$ is a hydrocarbyl group having 8 to 14 carbon atoms, 8 to 12 carbon atoms, or 8 to 10 carbon atoms, and M is a number from 3 to 8.

The hydrocarbyl group may be linear or branched, and saturated or unsaturated. In some embodiments, $R_2$ is a linear or branched $C_8$-$C_{16}$ alkyl or a linear group or branched. $C_8$-$C_{16}$ alkenyl group. In an embodiment, $R_2$ is a linear or branched $C_8$-$C_{16}$ alkyl, $C_8$-$C_{14}$ alkyl, or $C_8$-$C_{10}$ alkyl group. The alcohol may be derived from natural or synthetic feedstock. In one embodiment, the alcohol feedstock is coconut, containing predominantly $C_{12}$-$C_{14}$ alcohol, and oxo $C_{12}$-$C_{15}$ alcohols.

In an embodiment, the nonionic surfactant(s) present is from about 5 to about 40% by weight based on a total weight of the composition. In another embodiment, the nonionic surfactant(s) is present in an amount of from about 5 to about 30% by weight based on a total weight of the composition. In yet another embodiment, the nonionic surfactant(s) is present in an amount of from about 10 to about 25% by weight based on a total weight of the composition.

It should be appreciated that, in certain embodiments, the plurality of surfactants could also include additional surfactants, such as but not limited to, cationic surfactants, amphoteric (zwitterionic) surfactants, etc. In other embodiments, the structured liquid detergent composition is free of additional surfactants including cationic surfactants, amphoteric (zwitterionic) surfactants, etc.

Acid

The liquid detergent composition further includes an acid. In addition to the alkanolamine described above, the acid also tends to adversely affect the color stability of the liquid detergent composition. In an embodiment, the acid is a fatty acid, such as but not limited to coconut fatty acid, carboxylic acid, lauric acid, myristic acid, palmitic acid, stearic acid, topped palm kernel fatty acid, alkylbenzene sulfonic acid, and combinations thereof. The fatty acid may, for example, be obtained from palm kernel oil and has a backbone including from 12 to 20 carbon atoms. In a particular embodiment, the fatty acid is a coconut fatty acid. In an alternative embodiment, the acid is linear alkylbenzene sulfonic acid. The acid is present in the liquid detergent composition in an amount of from about 2 to about 20% by weight based on a total weight of the liquid detergent composition. In another embodiment, the acid is present in an amount of from about 4 to about 15% by weight based on a total weight of the liquid detergent composition.

Water

The liquid detergent composition further includes water, such as deionized water. Notably, the water content includes the water from any components provided in the form of an aqueous solution, as well as water that is added separately. In an embodiment, the total amount of water present in the composition is less than 30% by weight based on a total weight of the liquid detergent composition. In another embodiment, the total amount of water present in the composition is from about 5 to about 30% by weight based on the total weight of the liquid detergent composition. The liquid detergent composition having less than 30% by weight of water is said to have a low water content, and is suitable for use in unit dose detergent packs.

It should be appreciated that the liquid detergent composition could be formulated to have a higher content of water. In such instances, the liquid detergent composition could be used as a liquid detergent composition alone rather than as one incorporated into a unit dose pack.

Non-Aqueous Solvent

The liquid detergent composition may further include a non-aqueous solvent. The non-aqueous solvent is used to help solubilize the components of the liquid detergent composition, as well as to maintain homogeneity of the composition at various storage conditions. Additionally, the non-aqueous solvent serves as a water-binding agent to reduce water activity of the composition. This reduces water transfer of the composition to the surrounding water-soluble container of the unit dose detergent pack to avoid swelling and/or leakage through the water-soluble film material of the container.

In an embodiment, the non-aqueous solvent includes monovalent or polyvalent alcohols and glycol ethers. Non-limiting examples of the non-aqueous solvent include ethanol, propylene glycol, butylene glycol, pentylene glycol, hexylene glycol, heptylene glycol, octylene glycol, diethylene glycol, triethylene glycol, 2-methyl-1,3-propanediol, glycerol, 1,3-propanediol, triacetin, ethyl acetate, benzyl alcohol, polyethylene glycol having a molecular weight of from 200 to 3000 g/mol, and combinations thereof. In one particular embodiment, the liquid detergent composition includes glycerol and propylene glycol as non-aqueous solvents.

In an embodiment, the non-aqueous solvent is present in the composition in an amount of from about 10 to about 40% by weight based on a total weight of the liquid detergent composition. In another embodiment, the non-aqueous solvent is present in the composition in an amount of from about 15 to about 30% by weight based on a total weight of the liquid detergent composition. In yet another embodiment, the non-aqueous solvent is present in the composition in an amount of from about 15 to about 25% by weight based on a total weight of the liquid detergent composition.

Colorant

In an embodiment, the liquid detergent is free of a colorant. In this embodiment, the liquid detergent composition is said to be colorless. In another embodiment, the liquid detergent composition includes a colorant, such as a dye. Colorants suitable for use in the structured liquid detergent composition include dyes of a variety of different colors, such as blue, yellow, green, orange, green, purple, etc. Suitable dyes include, but are not limited to, chromophore types such as azo, anthraquinone, triarylmethane, methine quinophthalone, azine, oxazine, and thiazine which may be of any desired color, hue or shade, and are commercially available.

Additives

The liquid detergent composition may further include at least one additive. In an embodiment, the liquid detergent composition includes the alkanolamine as a neutralizing agent as described above. In another embodiment, the liquid detergent composition further includes an additional neutralizing agent, such as a hydroxide. Non-limiting examples of suitable hydroxides include sodium hydroxide, potassium hydroxide, ammonium hydroxide, calcium hydroxide, and/or the like.

The liquid detergent composition may further include, as an additive, a suspension polymer, such as an alkoxylated polyethyleneimine. The alkoxylated polyethyleneimine may have a polyethyleneimine backbone having a weight average molecular weight from about 300 to about 10,000. The polyethyleneimine backbone may be modified by either (1) one or two alkoxylation modifications per nitrogen atom depending, at least in part, on whether the modification occurs at an internal nitrogen atom or at a terminal nitrogen atom, in the polyethyleneimine backbone, the alkoxylation modification including the replacement of a hydrogen atom by a polyalkoxylene chain having an average of about 1 to about 40 alkoxy moieties per modification with the terminal alkoxy moiety of the alkoxylation modification capped with hydrogen, a $C_1$-$C_4$ alkyl, or combinations thereof, (2) a substitution of one $C_1$-$C_4$ alkyl moiety and one or two alkoxylation modifications per nitrogen atom depending, at least in part, on whether the substitution occurs at an internal nitrogen atom or at an terminal nitrogen atom, in the polyethyleneimine backbone, the alkoxylation modification including the replacement of a hydrogen atom by a polyalkoxylene chain having an average of about 1 to about 40 alkoxy moieties per modification with the terminal alkoxy moiety capped with hydrogen, a $C_1$-$C_4$ alkyl, or combinations thereof, or (3) a combination of (1) and (2).

The alkoxylation modification of the polyethyleneimine backbone includes the replacement of a hydrogen atom by a polyalkoxylene chain having an average of about 1 to about 40 alkoxy moieties, typically from about 5 to about 20 alkoxy moieties. The alkoxy moieties are selected from ethoxy (EO), 1,2-propoxy (1,2-PO), 1,3-propoxy (1,3-PO), butoxy (BO), and combinations thereof. In some embodiments, the polyalkoxylene chain is selected from ethoxy moieties and ethoxy/propoxy block moieties. The polyalkoxylene chain may be ethoxy moieties in an average degree of from about 5 to about 15 or the polyalkoxylene chain may be ethoxy/propoxy block moieties having an average degree of ethoxylation from about 5 to about 15 and an average degree of propoxylation from about 1 to about 16.

In an embodiment, the suspension polymer is an ethoxylated polyethyleneimine present in an amount of from about 0.1 to about 10% by weight based on a total weight of the liquid detergent composition. In another embodiment, the suspension polymer is an ethoxylated polyethyleneimine present in an amount of from about 4 to about 8% by weight based on a total weight of the liquid detergent composition.

The liquid detergent composition may further include, as an additive, a bittering agent. The bittering agent imparts a bitter taste to the composition thereby hindering accidental ingestion of the composition by children, animals, etc. Non-limiting examples of suitable bittering agents include denatonium benzoate, aloin, and/or the like. In an embodiment, the liquid detergent composition includes from about 0.01 to about 0.1% by weight of the bittering agent based on a total weight of the liquid detergent composition. In another embodiment, the liquid detergent composition includes about 0.05% by weight of the bittering agent based on a total weight of the liquid detergent composition.

As another additive, the composition may include an optical brightener. Suitable optical brighteners include stilbenes, distyrylbiphenyl derivatives, stilbene/naphthotriazole blends, oxazole derivatives, and/or coumarin brighteners. In an embodiment, the liquid detergent composition includes from about 0.01 to about 1% by weight of the optical brightener based on a total weight of the liquid detergent composition. In another embodiment, the liquid detergent composition includes about 0.2% by weight of the optical brightener based on a total weight of the liquid detergent composition.

The composition may further include sodium sulfite as an oxygen scavenger. In particular, the sodium sulfite reacts with oxygen to form sodium sulphate to lower the oxygen content, thereby reducing or even preventing formation of rust on various interior various components of the washing machine. Sodium sulfite is typically provided in the form of an aqueous solution, containing about 85% by weight of the sodium sulfite and about 15% by weight of water. It should be appreciated that the water content of the solution is taken into account when determining the total amount of water in the liquid detergent composition. In an embodiment, the sodium sulfite solution is present in an amount of from about 0.1 to about 5% by weight based on a total weight of the liquid detergent composition. In this embodiment, about 0.85 to about 4.25% by weight of active sodium sulfite is present in the liquid detergent composition.

The composition may further include, as an additive, one or more enzymes. The enzymes may be chosen amylolytic, proteolytic, cellulolytic, and/or lipolytic-type enzymes. Other suitable enzymes include, but are not limited to, proteases (such as bacterial proteases), amylases (such as bacterial amylases), lipases (such as fungal lipases), and cellulases (such as monocomponent cellulases). Blends of two or more enzymes may also be used, such as a protease/lipase blend, a protease/amylase blend, a protease/amylase/lipase blend, etc.

An antifoam agent may also be used to reduce or hinder the formation of foam. Suitable antifoam agents include, but are not limited to, a polyalkoxylated alkanolamide, amide, amine oxide, betaine, sultaine, $C_8$-$C_{18}$ fatty alcohols, and those disclosed in U.S. Pat. No. 5,616,781, the relevant portion(s) of which is incorporated hereby by reference. An auxiliary foam stabilizing surfactant, such as a fatty acid amide surfactant, may also be included in the composition, such as $C_8$-$C_{20}$ alkanol amides, monoethanolamides, diethanolamides, or isopropanolamides. Other suitable antifoam agents include those derived from phenylpropylmethyl substitute polysiloxanes.

The composition may further include a dye transfer inhibitor to help prevent colorants (e.g., a dye) from coming off a fabric and being deposited onto another fabric during a washing cycle. The dye transfer inhibitors are polymers adapted to entrap dyes in the washing liquor. Non-limiting examples of dye transfer inhibitors include homopolymers and copolymers of vinylpyrrolidone and vinylimidazole.

As another additive, the composition may include a soil release agent. Suitable soil release agents are polymers such as, but not limited to, a nonionic polyester of polypropylene terephthalate, a polyethylene glycol polyester, end-capped and non-end-capped sulfonated and unsulfonated PET/POET polymers of the type as disclosed in International Patent Publication Nos. WO2010/069957 and WO1995/032997, the relevant portions of which are incorporated herein by reference, polyethylene glycol/polyvinyl alcohol graft copolymers, and/or anionic hydrophobic polysaccharides.

Fragrances may include any fragrant substance or mixture of substances including natural fragrances (such as those extracted from flowers, herbs, leaves, roots, barks, woods, blossoms, plants, etc.), artificial fragrances (such as natural oils or oil constituents), encapsulated, and synthetically produced fragrances. Non-limiting examples of fragrances that may be used in the composition are set forth in U.S. Pat. Nos. 6,024,943; 6,056,949; 6,194,375; 6,458,754; 8,716,213; and 8,426,353 and in United States Patent Publication Nos. 2011/0224127 and 2017/0335237, the relevant portions of which are incorporated herein by reference.

The composition may further include, as another additive, an antimicrobial agent. Suitable antimicrobial agents include an antimicrobial, a germicide, or a fungicide. In an embodiment, the antimicrobial agent may be triclosan (5-chloro-2-(2,4-dichloro-phenoxy) phenol)), and/or the like.

It should be understood that other additives such as a chelator may also be present. Additionally, the additive(s) is/are present in an amount of from about 1 to about 30% by weight based on a total weight of the liquid detergent composition.

Unit Dose Detergent Pack

The unit dose detergent pack includes the pouch formed or made from the water-soluble film and, as mentioned above, the liquid detergent composition is releasably disposed within the pouch. Details of various embodiments of the liquid detergent composition are described above. The pouch defines at least one compartment and the liquid detergent composition is releasably disposed or encapsulated within the at least one compartment. The pouch may have a single compartment and the liquid detergent composition is releasably disposed within the single compartment. Alternatively, the pouch may have two or more compartments and the liquid detergent composition is releasably disposed within at least one of the two or more compartments. The other compartment(s) may include colorants or other components.

The pouch may be formed from a single continuous water-soluble film. In another embodiment, the pouch is formed from a plurality of water-soluble films joined and sealed to one another, such as along their edges such that the inner surfaces of the water-soluble films collectively define the compartment. In an embodiment, the film is water-soluble such that the film completely dissolves when exposed to water, such as in a washing machine for washing laundry. When the film dissolves, the pouch ruptures and the contents of the pouch (e.g., the liquid detergent composition) are released. As used herein, the term "water-soluble" means that least 2 grams of the solute (e.g., the film) dissolves in 5 liters of solvent (e.g., water) for a solubility of at least 0.4 grams per liter (g/l) at a temperature of 25° C. unless otherwise specified.

The film is desirably strong, flexible, shock resistant, and non-tacky during storage at both high and low temperatures and high and low humidities. Non-limiting examples of suitable materials for the water-soluble film include polyvinyl alcohol, polyvinyl acetate, film-forming cellulosic polymers, polyacrylic acid, polyacrylamide, polyanhydride, polysaccharide, and combinations thereof. In a particular embodiment, the water-soluble film is polyvinyl alcohol.

The following examples are meant to illustrate the invention and are not to be viewed in any way as limiting the scope of the present claims.

EXAMPLES

Example 1

Two samples of a liquid detergent composition were prepared. One of the Samples (Sample 1) was prepared including a copolymer formed from copolymerization of diallyldimethylammonium chloride (DADMAC) monomer and an acrylamide. The other one of the samples (Control 1) was prepared as a control sample without a DADMAC-Acrylamide co-polymer. The compositions of Sample 1 and Control 1 are set forth in Table 1 below.

TABLE 1

| Ingredient | Activity (%) | Control 1 (% by weight) | Sample 1 (% by weight) |
|---|---|---|---|
| Glycerol | 99+ | 12.42 | 10.92 |
| Alcohol Ethoxylate, 25-7 | 99+ | 23.07 | 12.07 |
| Propylene Glycol | 99+ | 8.21 | 8.21 |
| Sodium Sulfite, 15% solution | 15 | 1.33 | 1.33 |
| Monoethanolamine | 99 | 3.15 | 3.15 |
| Deionized Water | 100 | 4.57 | 2.73 |
| Linear Alkylbenzene Sulfonate (LAS) | 96.5 | 5.00 | 5.00 |
| Coconut Fatty Acid | 100 | 10.00 | 10.00 |
| Alkyl Ether Sulfate, 25-3 | 60 | 26.00 | 26.00 |
| Bittering Agent | 25 | 0.05 | 0.05 |
| Optical Brightener | 100 | 0.20 | 0.20 |
| Release Agent (Alkoxylated Polyethyleneimine) | 80 | 6.00 | 6.00 |
| DADMAC-Acrylamide co-polymer | 44.5 | 0 | 3.33 |

* The "Activity" refers to the percentage (%) of active material present in the ingredient.
* The "% by weight" of each ingredient includes the active material and possible another material (such as, for example, water in instances where the ingredient is provided in the form of a solution).

Figure 2A:
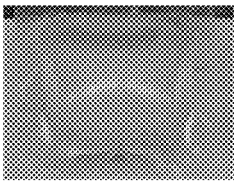
FIGS. 2A-2G are photographs of unit dose detergent packs including a liquid detergent composition including the copolymer after aging for one-week at varying temperatures.
Figure 3A:
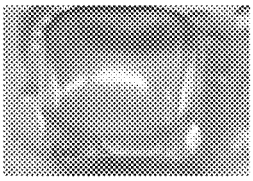
FIGS. 3A-3F are photographs of unit dose detergent packs including the liquid detergent composition without the copolymer after aging for two weeks at varying temperatures.
Figure 4A:
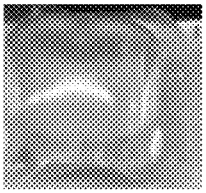
FIGS. 4A-4F are photographs of unit dose detergent packs including the liquid detergent composition including the copolymer after aging for two weeks at varying temperatures.
Figure 1B:
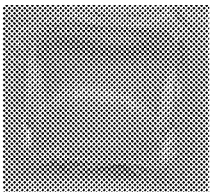
Figure 2B:
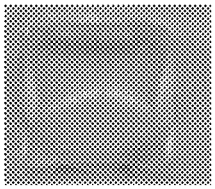
Figure 3B:
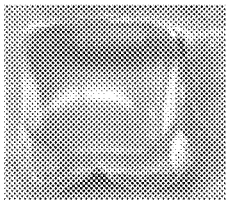
Figure 4B:
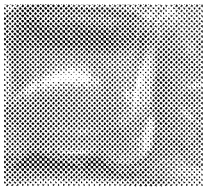
Figure 1C:
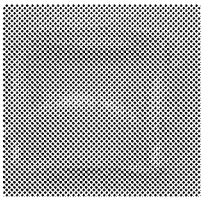
Figure 2C:
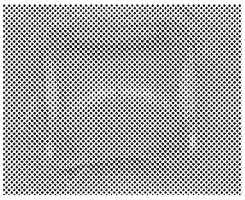
Figure 3C:
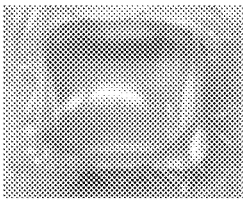
Figure 4C:
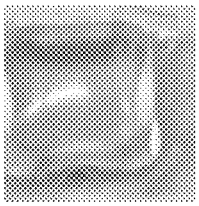
Figure 1D:
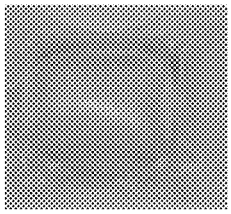
Figure 2D:
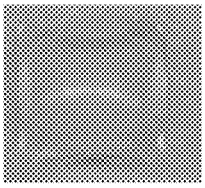
Figure 3D:
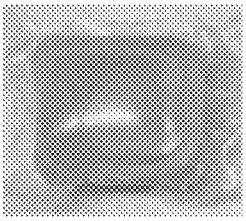
Figure 4D:
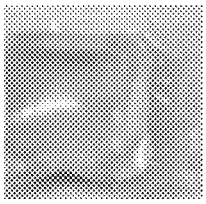
Figure 1E:
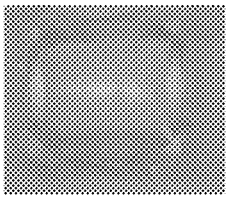
Figure 2E:
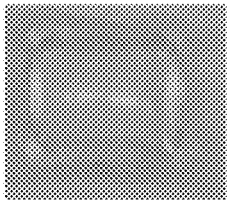
Figure 3E:
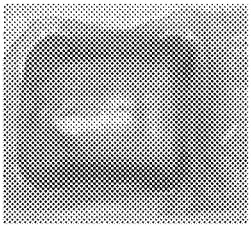
Figure 4E:
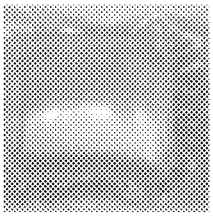
Figure 1F:
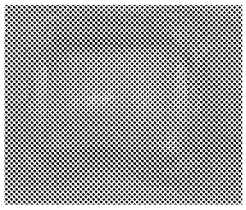
Figure 2F:
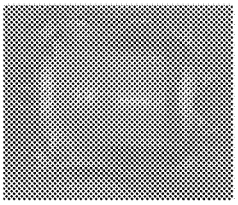
Figure 3F:
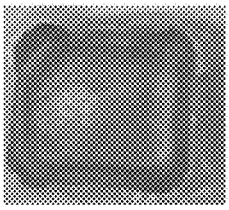
Figure 4F:
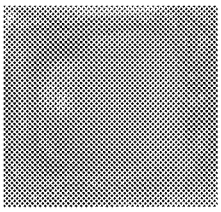
Figure 1G:
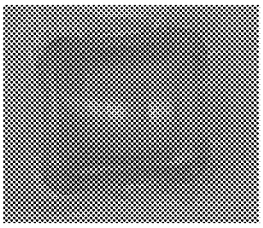
Figure 2G:
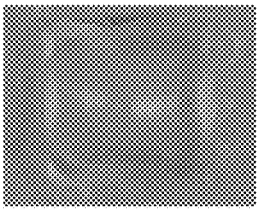

The liquid detergent composition Control 1 was batched and then disposed within a pouch formed from polyvinyl alcohol (PVOH) to form a unit dose pack as shown in FIGS. 1A and 3A. The liquid detergent composition Sample 1 was also batched and then disposed within a pouch formed from PVOH to form another unit dose pack as shown in FIGS. 2A and 4A. The unit dose packs were then stored at temperatures varying from 40° F. to 125° F., and photographs of the unit dose packs including the Control 1 (FIGS. 1B-1G) and the unit dose packs including Sample 1 (FIGS. 2B-2G) were taken at the end of a one-week period. Photographs of the unit dose packs including the Control 1 (FIGS. 3B-3F) and the unit dose packs including Sample 1 (FIGS. 4B-4F) were taken at the end of a two-week period.

As shown in the FIG. 1-4 series, the unit dose packs including Sample 1 (the FIGS. 2 and 4 series including a DADMAC-Acrylamide co-polymer) showed significantly less yellow discoloration within the one and two-week time periods, particularly when stored at higher temperatures compared to the unit dose packs including the Control 1 (the FIGS. 1 and 3 series without a DADMAC-Acrylamide co-polymer). These results show an improvement in color stability for unit dose packs with the liquid detergent composition including a DADMAC-Acrylamide co-polymer compared to the liquid detergent composition that is free of (without) a DADMAC-Acrylamide co-polymer.

Figure 5A:
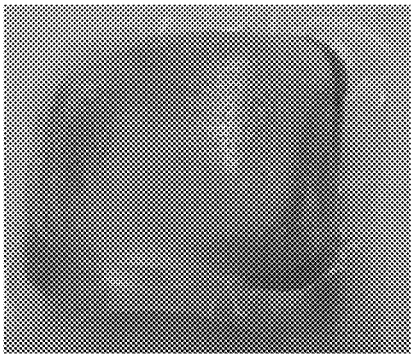
FIGS. 5A and 5B are enlarged photographs of the unit dose detergent compositions including the liquid detergent composition without the copolymer (FIG. 5A) and including the copolymer (FIG. 5B) after aging for one week at 125° F.
Figure 5B:
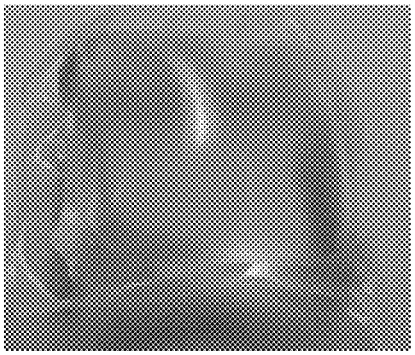
Figure 6A:
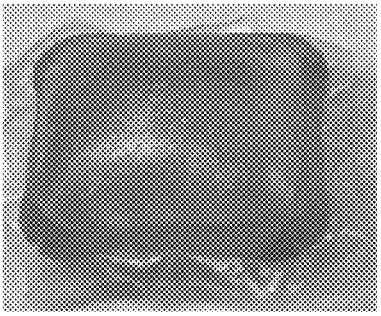
FIGS. 6A and 6B are enlarged photographs of the unit dose detergent compositions including the liquid detergent composition without the copolymer (FIG. 6A) and including the copolymer (FIG. 6B) after aging for two weeks at 125° F.
Figure 6B:
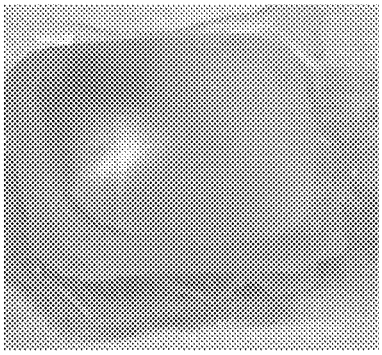

FIGS. 5A and 5B are enlarged photographs of the unit dose packs containing the Control 1 and Sample 1, respectively, after aging for the one-week period at 125° F. FIGS. 6A and 6B are enlarged photographs of the unit dose packs containing the Control 1 and Sample 1, respectively, after aging for the two-week period at 125° F. The enlarged photographs show less efflorescence of the PVOH film (caused from the sodium sulfite and the AES surfactant) occurred with the liquid detergent composition including a DADMAC-Acrylamide co-polymer compared to the unit dose pack with the liquid detergent composition free of a DADMAC-Acrylamide co-polymer after aging.

Example 2

Four samples of a liquid detergent composition were prepared. One of the samples (Control 2) was prepared as a control sample including sodium sulfite. Another one of the samples (Control 3) was prepared as another control sample that is free of sodium sulfite. Another one of the samples (Sample 2) was prepared including sodium sulfite and a DADMAC-Acrylamide co-polymer and represents an example of the present disclosure. Yet another one of the samples (Sample 3) was prepared including a DADMAC-Acrylamide co-polymer and free of a sodium sulfite. The compositions of Controls 2 and 3 and Samples 2 and 3 are set forth in Table 2 below.

TABLE 2

| Ingredient | Control 2 (wt %) | Control 3 (wt %) | Sample 2 (wt %) | Sample 3 (wt %) |
|---|---|---|---|---|
| Glycerol | 12.42 | 12.62 | 10.92 | 11.21 |
| Alcohol Ethoxylate, 25-7 | 23.07 | 23.07 | 23.07 | 23.07 |
| Propylene Glycol | 8.21 | 8.21 | 8.21 | 8.21 |
| Sodium Sulfite, 15% solution | 1.33 | 0 | 1.33 | 3.15 |
| Monoethanolamine | 3.15 | 3.15 | 3.15 | 0 |
| Deionized Water | 4.57 | 5.70 | 2.73 | 3.87 |
| Linear Alkylbenzene Sulfonate (LAS) | 5.00 | 5.00 | 5.00 | 5.00 |
| Coconut Fatty Acid | 10.00 | 10.00 | 10.00 | 10.00 |
| Alkyl Ether Sulfate, 25-3 | 26.00 | 26.00 | 26.00 | 26.00 |
| Bittering Agent | 0.05 | 0.05 | 0.05 | 0.05 |
| Optical Brightener | 0.20 | 0.20 | 0.20 | 0.20 |
| Release Agent | 6.00 | 6.00 | 6.00 | 6.00 |
| DADMAC-Acrylamide co-polymer | 0 | 0 | 3.33 | 3.33 |

Each of the liquid detergent compositions (Controls 2 and 3 and Samples 2 and 3) was batched and then disposed within a pouch formed from polyvinyl alcohol (PVOH) to form a unit dose pack. The four unit dose packs were placed in storage at 113° F. for a two-week period, popped, and then the liquid detergent composition was measured to determine a brightness using a 457 nm Brightness test with an Ultrascan VIS Spectrophotometer available from Hunter Associates Laboratory, Inc. (Reston, Va.). In this test, a brighter (or less yellow-colored) sample would have a higher 457 nm Brightness value (a unitless value).

Figure 7:
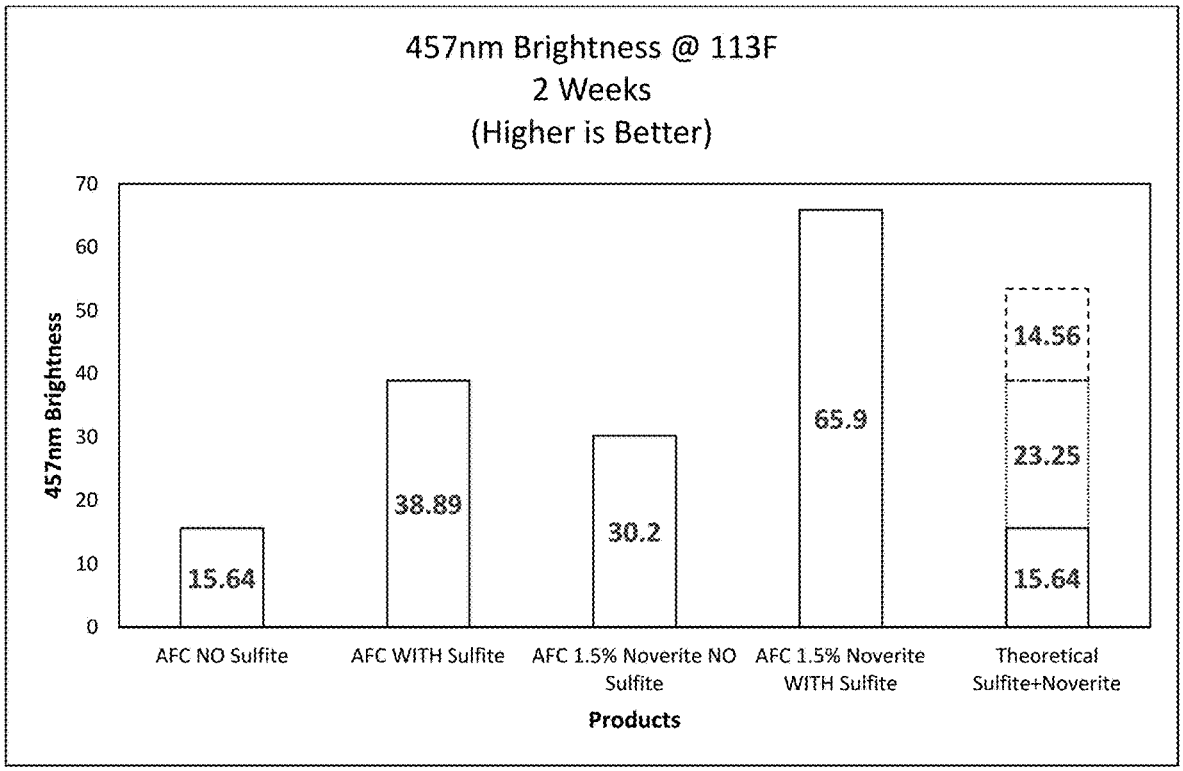
FIG. 7 is a bar graph showing 457 nm Brightness of a control liquid detergent composition free of an alkali metal sulfite (A), another control liquid detergent composition including an alkali metal sulfite (B), a liquid detergent composition including the copolymer (C), and a liquid detergent composition including the copolymer and an alkali metal sulfite (D) after aging for a two-week period at 113° F.

As shown in FIG. 7, the results indicate that the contribution of the sodium sulfite alone (Control 2) to color stability is characterized by a difference of 457 nm Brightness from Control 3 to Control 2 and is expressed as a delta (Δ) of 23.25. The contribution of the DADMAC-Acrylamide co-polymer alone to the color stability is characterized by a difference of 457 nm Brightness from Sample 3 to Control 2 and is expressed as a delta of 14.56. As such, one would expect the addition of the sulfite and the DADMAC to the liquid composition to be the sum of the differences or 37.81 (i.e., 23.25+14.56). However, the actual contribution of the combination of the sulfite and the DADMAC-Acrylamide co-polymer is characterized by the difference from Sample 2 to Control 1, which is expressed as a delta of 50.26. This brightness value is much higher than the simple addition of the sulfite and the DADMAC-Acrylamide co-polymer to the liquid composition mentioned above, demonstrating that the sulfite and the DADMAC-Acrylamide co-polymer has a synergistic effect on the improvement of color stability in storage at a temperature of 113° F.

Example 3

The same four liquid detergent compositions (Controls 2 and 3 and Samples 2 and 3) in Example 2 above were prepared for Example 3. Each of the liquid detergent compositions was batched and then disposed within a pouch formed from polyvinyl alcohol (PVOH) to form a unit dose pack. The four unit dose packs were placed in storage at 125° F. for a two-week period, popped, and then the liquid detergent composition was measured to determine the brightness using the 457 nm Brightness test described above.

Figure 8:
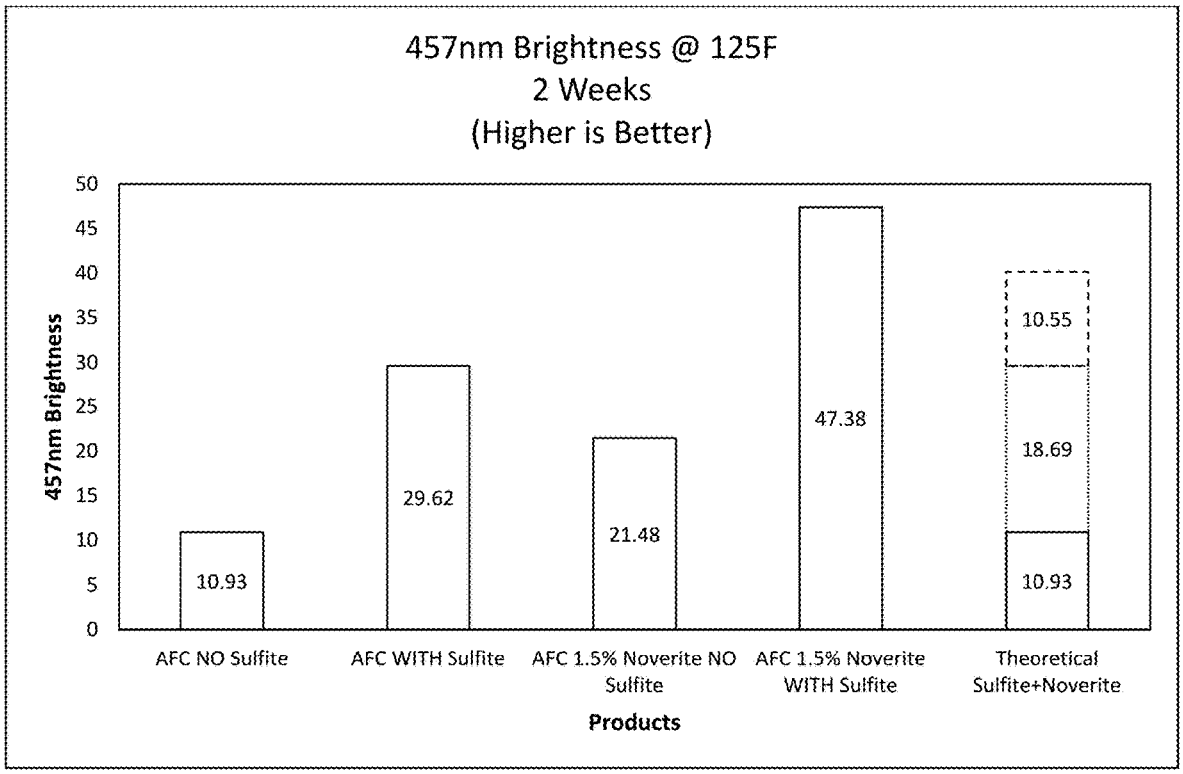
FIG. 8 is a bar graph showing 457 nm Brightness of a control liquid detergent composition free of an alkali metal sulfite (A), another control liquid detergent composition including an alkali metal sulfite (B), a liquid detergent composition including the copolymer (C), and a liquid detergent composition including the copolymer and an alkali metal sulfite (D) after aging for a two-week period at 125° F.
Figures 9A, 9B, 9C, 9D:
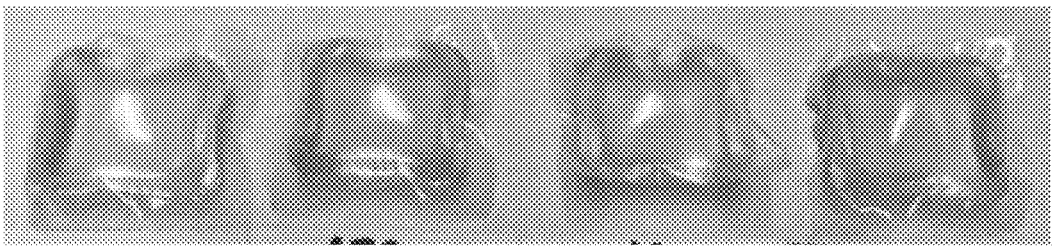
FIGS. 9A-9D are photographs the four unit dose detergent packs including compositions (A), (B), (C), and (D), respectively, from FIG. 8 prior to aging.

As shown in FIG. 8, the results indicate a similar result as shown in Example 2 above. Specifically, after aging for a two-week period at 125° F., the results show a contribution of sulfite alone to color stability by a different of 457 nm Brightness measured from Control 3 to Control 1, which is a delta (Δ) of 18.69. The contribution of DADMAC-Acrylamide co-polymer alone to the color stability is characterized by a difference of 457 nm Brightness from Sample 3 to Control 2, which is a delta of 10.55. As such, one would expect the addition of the sulfite and the DADMAC-Acrylamide co-polymer to the liquid composition to be the sum of the differences or 29.24 (i.e., 18.69+10.55). However, the actual contribution of the combination of the sulfite and the DADMAC-Acrylamide co-polymer is characterized by the difference from Sample 2 to Control 1, which is a delta of 36.45. This brightness value is much higher than the simple addition of the sulfite and the DADMAC-Acrylamide co-polymer to the liquid composition mentioned above, demonstrating that the sulfite and the DADMAC-Acrylamide co-polymer has a synergistic effect on the improvement of color stability in storage at the higher temperature of 125° F.

Example 4

Figures 10A, 10B, 10C, 10D:
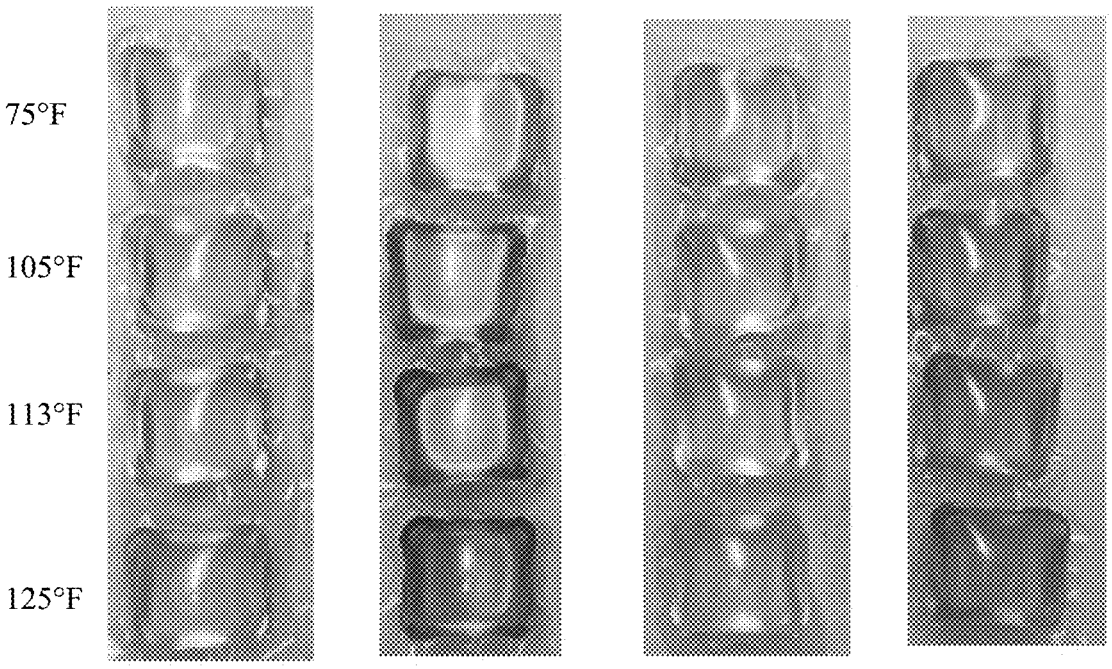
FIG. 10A is a photograph of a series of unit dose packs each including the liquid detergent composition free of an alkali metal sulfite (A) after aging for a one-week period at varying temperatures.
FIG. 10B is a photograph of a series of unit dose packs each including the liquid detergent composition including an alkali metal sulfite (B) after aging for a one-week period at varying temperatures.
FIG. 10C is a photograph of a series of unit dose packs each including the liquid detergent composition including the copolymer (C) after aging for a one-week period at varying temperatures.
FIG. 10D is a photograph of a series of unit dose packs each including the liquid detergent composition including the copolymer and an alkali metal sulfite (D) after aging for a one-week period at varying temperatures.
Figures 11A, 11B, 11C, 11D:
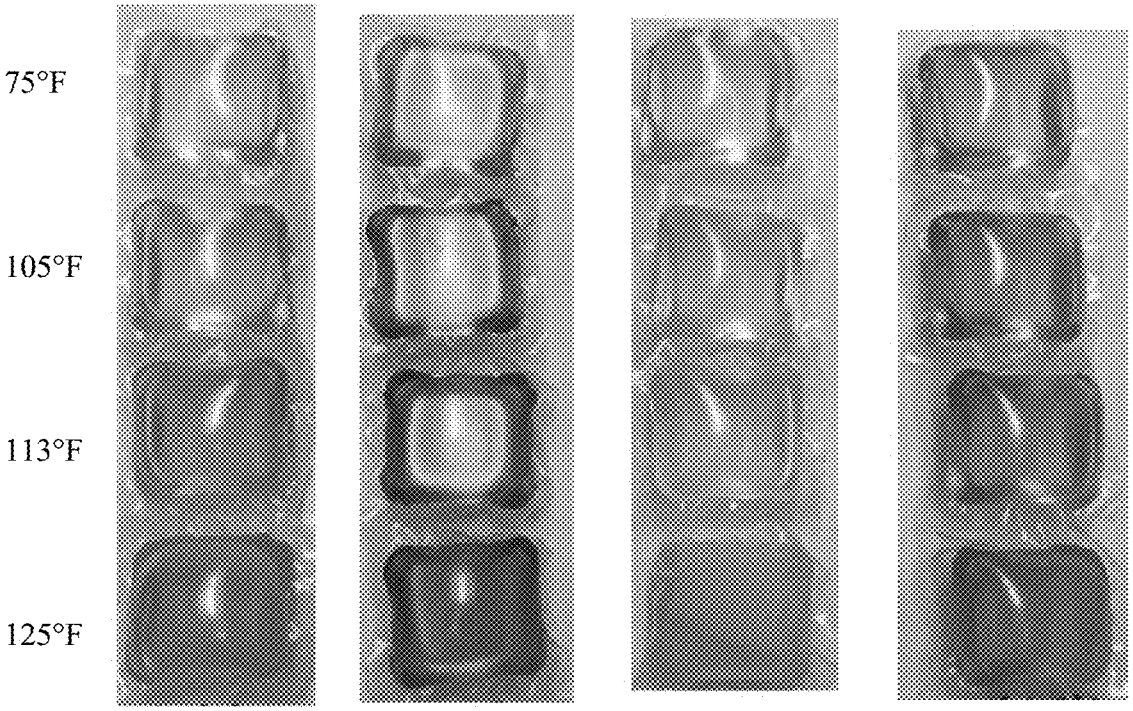
FIG. 11A is a photograph of a series of unit dose packs each including the liquid detergent composition free of an alkali metal sulfite (A) after aging for a two-week period at varying temperatures.
FIG. 11B is a photograph of a series of unit dose packs each including the liquid detergent composition including an alkali metal sulfite (B) after aging for a two-week period at varying temperatures.
FIG. 11C is a photograph of a series of unit dose packs each including the liquid detergent composition including the copolymer (C) after aging for a two-week period at varying temperatures.
FIG. 11D is a photograph of a series of unit dose packs each including the liquid detergent composition including the copolymer and an alkali metal sulfite (D) after aging for a two-week period at varying temperatures.

FIGS. 9A-9D are photographs of the four unit dose packs formulated in Example 2 above (i.e., Control 2, Control 3, Sample 2, and Sample 3, respectively) taken prior to aging. Each of the unit dose packs were aged for a one-week period at varying temperatures and photographs were taken. FIG. 10A is a photograph of the unit dose packs containing Control 2 after aging at 75° F., 105° F., 113° F., and 125° F. FIGS. 10B, 10C, and 10D are photographs of the unit dose packs containing Control 3, Sample 2, and Sample 3, respectively, after aging at 75° F., 105° F., 113° F., and 125° F. FIGS. 11A, 11B, 11C, and 11D are photographs of the series of unit dose packs of FIGS. 10A, 10B, 10C, and 10D, respectively, after aging for a two-week period of time. The results show an improvement in color stability of the liquid detergent composition with Sample 3 (containing DADMAC-Acrylamide co-polymer alone), but a much more significant improvement in color stability with Sample 2 (containing the sulfite and the DADMAC-Acrylamide co-polymer).

As used herein, the article "a," "an," and "the" can be used herein to refer to one or more than one (i.e., to at least one) of the grammatical object of the article unless the language and/or context clearly indicates otherwise.

As used herein, the term "about" is understood by persons of ordinary skill in the art and varies to some extent depending upon the context in which the term is used. If there are uses of the term which are not clear to persons of ordinary skill in the art, given the context in which the term is used, "about" means up to plus or minus 10% of the particular term.

It is to be understood that one or more values described above may vary by +/−5%, +/−10%, +/−15%, +/−20%, etc. so long as the variance remains within the scope of the present disclosure. It is also to be understood that the appended claims are not limited to express particular compounds, compositions, or methods described in the detailed description, which may vary between particular embodiments which fall within the scope of the appended claims.

It is also to be understood that any ranges or subranges relied upon in describing the various embodiments of the present disclosure independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present disclosure, and such ranges and subranges may be further delineated into relevant halves, thirds, quarters, fifths, and so on. Additionally, an individual number within a disclosed range may be relied upon and provides adequate support for specific embodiments within the scope of the appended claims. For example, a range "of from about 100 to about 200" includes various individual integers such as 101, 102, 103, etc., as well as individual numbers including a decimal point (or fraction) such as 100.1, 100.2, etc., which may be relied upon and provide adequate support for specific embodiments within the scope of the appended claims.

The invention has been described in an illustrative manner, and it is to be understood that the terminology which has been used is intended to be in the nature of words of description rather than of limitation. It is now apparent to those skilled in the art that many modifications and variations of the present invention are possible in light of the above teachings. It is, therefore, to be understood that the invention may be practiced otherwise than as specifically described.

What is claimed is:

1. A unit dose detergent pack comprising:

a pouch formed from a water-soluble film; and a liquid detergent composition releasably disposed within said pouch and comprising:

an alkanolamine;

an acid selected from the group consisting of coconut fatty acid, carboxylic acid, lauric acid, myristic acid, palmitic acid, stearic acid, topped palm kernel fatty acid, alkyl benzene sulfonic acid, and combinations thereof;

from 0.1 to about 5% by weight of a copolymer formed from first and second monomers with said first monomer being diallyldimethylammonium chloride (DADMAC), the % by weight being based on a total weight of said liquid detergent composition; and an alkali metal sulfite or bi sulfite, wherein said copolymer and said alkali metal sulfite or bisulfite interact with at least one of said alkanolamine and said acid to reduce discoloration of said liquid detergent composition, and wherein said liquid detergent composition exhibits at least 40 units of brightness at a wavelength of about 457 nm after aging for about two weeks at about 45° C. measured using a visible-range color measurement spectrophotometer.

2. The unit dose detergent pack as set forth in claim 1 wherein said second monomer of said copolymer is acrylamide.

3. The unit dose detergent pack as set forth in claim 1 wherein said alkali metal sulfite is selected from the group consisting of from sodium sulfite, potassium sulfite, and combinations thereof, and said alkali metal bisulfite is selected from the group consisting of from sodium bisulfite, potassium bisulfite, and combinations thereof.

4. The unit dose detergent pack as set forth in claim 1 wherein said liquid detergent composition comprises from about 0.01 to about 5% by weight of said alkali metal sulfite or bisulfite based on a total weight of said liquid detergent composition.

5. The unit dose detergent pack as set forth in claim 1 wherein said alkanolamine is selected from the group consisting of from monoethanolamine, diethanolamine, triethanolamine, isopropylamine, and combinations thereof.

6. The unit dose detergent pack set forth in claim 1 wherein said liquid detergent composition further copmrises from about 10 to about 40% by weight of anionic surfactant based on a total weight of said liquid detergent composition.

7. The unit dose detergent pack as set forth in claim 6 wherein said anionic surfactant is an alkyl ether sulfate, and said copolymer and said alkali metal sulfite or bisulfite further interact to reduce efflorescence of said water-soluble film caused at least partially by said alkyl ether sulfate.

8. The unit dose detergent pack as set forth in claim 1 wherein said liquid detergent composition further comprises from about 5 to about 30% by weight of water based on a total weight of the liquid detergent composition.

9. The unit dose detergent pack as set forth m claim 1 wherein said liquid detergent composition is free of a colorant.

10. A liquid detergent composition comprising:

an alkanolamine;

an acid selected from the group consisting of coconut fatty acid, carboxylic acid, lauric acid, myristic acid, palmitic acid, stearic acid, topped palm kernel fatty acid, alkyl benzene sulfonic acid, and combinations thereof;

about 0.1 to about 5% by weight of a copolymer formed from first and second monomers with said first monomer being diallyldimethylammonium chloride (DADMAC), the % by weight being based on a total weight of the liquid detergent composition; and an alkali metal sulfite or bi sulfite, wherein said copolymer and said alkali metal sulfite or bisulfite interact with at least one of said alkanolamine and said acid to reduce discoloration of said liquid detergent composition, and wherein said liquid detergent composition exhibits at least 40 units of brightness at a wavelength of about 457 nm after aging for about two weeks at about 45° C. measured using a visible-range color measurement spectrophotometer.

11. The liquid detergent composition as set forth in claim 10 wherein said second monomer of said copolymer is acrylamide.

12. The liquid detergent composition as set forth in claim 10 wherein said alkali metal sulfite is selected from the group consisting of from sodium sulfite, potassium sulfite, and combinations thereof, and said alkali metal bisulfite is selected from the group consisting of from sodium bisulfite, potassium bisulfite, and combinations thereof.

13. The liquid detergent composition as set forth in claim 10 wherein said liquid detergent composition comprises:

from about 0.01 to about 5% by weight of said alkali metal sulfite or bisulfite based on a total weight of said liquid detergent composition.

14. The liquid detergent composition as set forth in claim 10 wherein said alkanolamine is selected from the group consisting of from monoethanolamine, diethanolamine, triethanolamine, isopropylamine, and combinations thereof.

15. The liquid detergent composition set forth in claim 10 wherein said liquid detergent composition further comprises from about 5 to about 30% by weight of a nonionic surfactant based on a total weight of said liquid detergent composition.

16. The liquid detergent composition as set forth in claim 10 wherein said liquid detergent composition is free of a colorant.

17. The liquid detergent composition of claim 15 wherein the composition comprises about 1.5% by weight DADMAC-Acrylamide copolymer and sodium sulfite.

* * * * *